US005833199A

United States Patent [19]

Benting et al.

[11] Patent Number: 5,833,199

[45] Date of Patent: Nov. 10, 1998

[54] MUSIC STAND

[75] Inventors: Gary M. Benting, Owatonna; Eric J. Mueller, Minneapolis; David R. Boeddeker, Owatonna; Cindy Weber, Minneapolis, all of Minn.

[73] Assignee: Wenger Corporation, Owatonna, Minn.

[21] Appl. No.: 753,587

[22] Filed: Nov. 26, 1996

Related U.S. Application Data

[63] Continuation-in-part of Ser. No. 647,416, May 9, 1996, abandoned.

[51] Int. Cl.[6] ..... A47B 97/04

[52] U.S. Cl. ..... 248/441.1; 248/414; 248/910

[58] Field of Search ..... 248/414, 441.1, 248/450, 910, 452

[56] References Cited

U.S. PATENT DOCUMENTS

| | | | |
|---|---|---|---|
| D. 263,361 | 3/1982 | Johnson et al. . | |
| D. 314,873 | 2/1991 | Wenger et al. . | |
| 568,139 | 9/1896 | Haynes . | |
| 824,596 | 6/1906 | Smith | 248/414 X |
| 856,679 | 6/1907 | Buckland . | |
| 1,232,564 | 7/1917 | Karges | 248/414 |
| 1,270,004 | 6/1918 | Chappell . | |
| 1,384,861 | 7/1921 | Buckland . | |
| 1,767,439 | 6/1930 | Edelmann . | |
| 2,799,968 | 7/1957 | Wythe . | |
| 3,794,284 | 2/1974 | Guenther | 248/441.1 |
| 4,076,308 | 2/1978 | Slabon et al. . | |
| 4,087,757 | 5/1978 | Waters | 248/441.1 |
| 4,650,145 | 3/1987 | Natzel et al. . | |
| 4,671,479 | 6/1987 | Johnson et al. . | |
| 4,819,902 | 4/1989 | Wenger et al. . | |
| 5,354,031 | 10/1994 | Bilotti . | |
| 5,366,197 | 11/1994 | Westland . | |

FOREIGN PATENT DOCUMENTS

| | | | |
|---|---|---|---|
| 2150427 | 7/1985 | United Kingdom | 248/441.1 |

*Primary Examiner*—James R. Brittain
*Attorney, Agent, or Firm*—Patterson & Keough, P.A.

[57] ABSTRACT

A lightweight, durable music. The stand includes a base, telescoping upright support assembly, and rack, all formed from a durable, lightweight synthetic resin. The rack includes a matrix of support ribs that provide the rack with exceptional durability in a lightweight structure. The rack includes a bracket receiving structure and a recess for receiving batons, writing instruments and the like in noninterfering relationship with the documents held by the rack. The base includes a plurality of central weights to lower the center of gravity of the stand, such that the stand is provided with excellent stability from a compact footprint.

17 Claims, 4 Drawing Sheets

MUSIC STAND

CROSS-REFERENCES TO RELATED APPLICATIONS

This is a continuation-in-part of U.S. patent application Ser. No. 08/647,416, filed May 9, 1996, abandoned.

FIELD OF THE INVENTION

The present invention relates to devices which hold information for musicians, conductors and orators. More particularly, the present invention is a lightweight, durable stand that is particularly useful for securely holding and displaying printed music or other documents at an easily varied height, and for providing a resting place for other materials such as batons or writing implements, in noninterfering relationship with the documents.

BACKGROUND OF THE INVENTION

Stands for holding sheet music for musicians and conductors and printed notes or manuscripts for orators are well known. Such stands are usually made of metal and are heavy, thereby being difficult and awkward to set up, transport and store. Those stands made of more lightweight materials often have stability problems, being easily tipped over unless the base extends outwardly to a. greater than desired length. An extended base can interfere with foot movement of the musician or orator, and is proven to being bumped, thereby tipping the stand and spilling its contents.

Furthermore, batons and pencils are not easily stored on these stands in such a fashion that the user can leaf through the pages without either knocking the articles off of the stand or cover the articles with pages, thereby preventing the user from quickly and easily locating and retrieving the articles when needed.

U.S. Pat. No. 4,819,902, assigned to the assignee of the present invention, is conveniently portable and can be set up quickly and easily, but is designed to be made almost entirely of metal. The base of the stand, in the setup configuration, is extended to provide for stability. U.S. Pat. No. 4,650,145, also assigned to the assignee of the present invention, provides a unique mechanism for vertically adjusting the height of the rack or desk of a music stand to any desired height. The design of the 145 music stand, however, again contemplates the use of relatively heavy metal materials.

It would be desirable to provide a music or oratory stand of lightweight material that would be stable without an excessively wide base. It would further be desirable to provide such a lightweight stand with the ability to store articles in a cavity or recess behind the leaves or pages being placed thereupon, such that the articles were easily and quickly located and retrieved when needed.

Finally, it would be desirable for such a stand to be able to securely accommodate a clip for securely clamping a lamp to the rack, or to securely clamp pages to the stand, notwithstanding the lightweight and reduced dimensions of the stand.

SUMMARY OF THE INVENTION

The problems outlined above are in large measure solved by the lightweight, durable music stand in accordance with the present invention. The stand hereof is primarily made up of synthetic resin materials. The rack of the stand is specifically designed to take advantage of the synthetic resin material, and presents a lightweight, visually appealing, and extremely sturdy platform for the holding of music sheets and like documents. The base of the stand, also made from a synthetic resin material, is designed with three central weights, presenting the rack with a low center of gravity, such that the stand is stable without the need for a large base footprint. The rack includes a clamp receiving structure to provide for positive coupling of brackets and clamps to the top of the rack, notwithstanding the overall thin cross section of the rack. A recessed, lower cavity on the rack provides a convenient temporary storage place for batons or writing instruments.

BRIEF DESCRIPTION OF THE DRAWINGS

FIG. 14 is a simplified, side elevational view of the mounting device, with phantom lines depicting the range of motion; and.

DETAILED DESCRIPTION OF THE DRAWINGS

Figure 1:
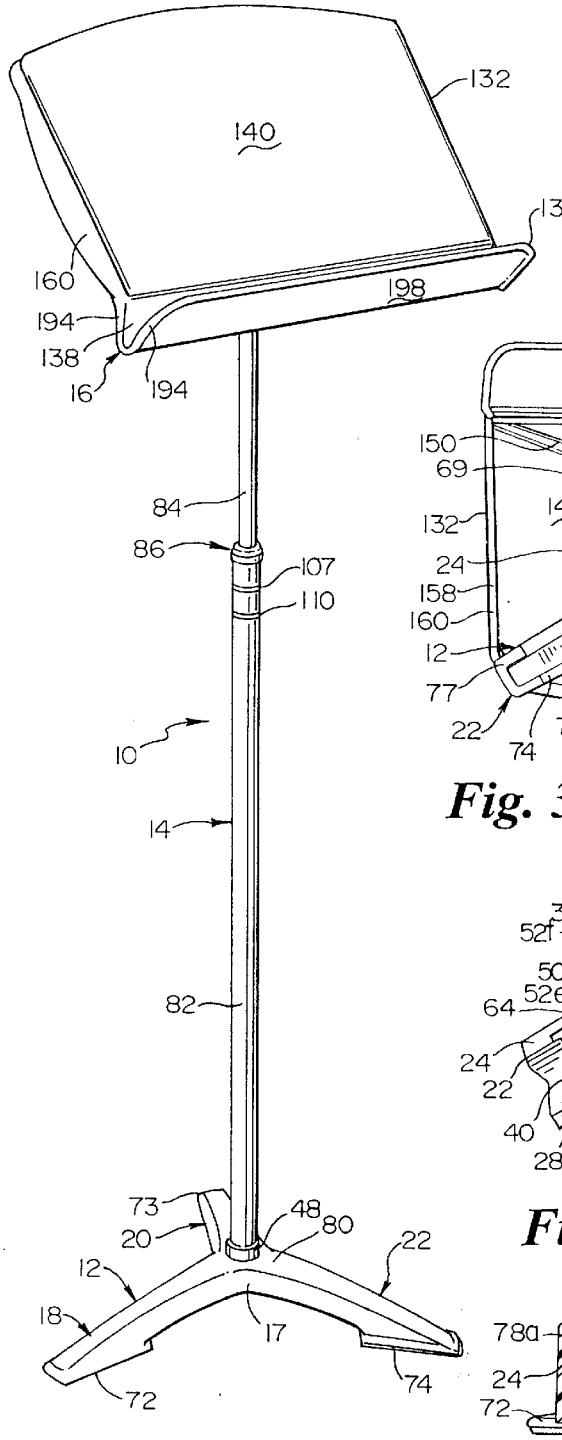
FIG. 1 is a perspective view of the music stand in accordance with the present invention.

Referring to the drawings, the stand 10 of the present invention broadly includes unitary base 12, upright support assembly 14, and rack 16.

Base 12 is a unitary structure consisting of a central portion 17, with feet: 18, 20, 22 extending radially therefrom. Viewed from the bottom, unitary base 1. includes side walls 24, 26, 28 and arcuate top walls 36, 38, 40. Each side wall 24, 26, 28 has an interior central recessed portion 30, 32, 34 in the vicinity of central portion 17. each recessed portion 30, 32, 34 is upwardly recessed from the bottom edge of side walls 24, 26, 28 and has a flattened bottom surface. Arcuate top walls 36, 38, 40 are continuous with side walls 24, 26, 28. Top walls 36, 38, 40 form the top surfaces of legs 18, 20, 22 and are continuous with the central portion 17 of base 12.

Cross walls 42, 44, 46 are outwardly proximate to recessed portions 30, 32, 34. The cross walls 42, 44, 46 extend generally perpendicular to side walls 24, 26, 28 and top walls 36, 38, 40 of feet 18, 20, 22. Cross walls 42, 44, 46 extend vertically upward from a flush alignment with the flattened bottom surfaces of recessed portions 30, 32, 34 to fully contact and join each adjacent side wall 24, 26, 28 and top wall 36, 38, 40.

Cylindrically shaped member 48 is positioned at the center of base 12. The member 48 is integrally molded with base 12, and includes opening 50. Diagonal cross walls 52a-52f extend radially and outwardly from member 48 to side walls 24, 26, 28. Cross walls 42, 44, 46 and diagonal cross walls 52*a*–52*f* define cavities 54, 56, 58 within legs 18, 20, 22, respectively. Cylindrically shaped weights 60, 62, 64 are disposed within each of cavities 54, 56, 58 and are dimensioned to snugly fit therewithin. Plate 66, configured to conform to the contours defined by recessed portions 30, 32, 34 and cross walls 42, 44, 46 covers the central portion 17 and is secured by washer 68 and bolt 69. Alternatively, the central portion 17 of base 12 can be subjected to sonic welding once the plate 66 is in place, thereby securely attaching weights 60, 62, 64 within the cavities 54, 56, 58, and permanently attaching the plate 66 to the base 17. The washer 68 can then be dispensed with, with the head 70 of bolt 69 impinging directly on the bottom of cylindrical member 48.

Figure 2:
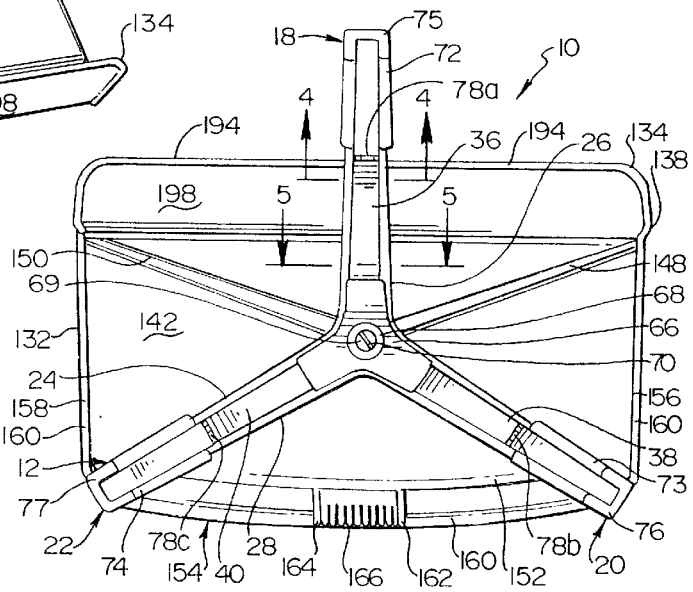
FIG. 2 is a bottom plan view thereof.

Pads 72, 73, 74 are carried by legs 18, 20, 22. The pads 72, 73, 74 extend for a substantial length along the bottom peripheries of feet 18, 20, 22. Pads 72, 73, 74 generally define a seating plane for supporting the stand on a level floor or stage surface. Referring to FIG. 2, pad tips 72, 73, 74 are disposed at the center ends of pads 72, 73, 74 and provide a slight downward projection of the pads 72, 73, 74 for engaging a floor surface. Outer cross walls 78*a*–78*c* are positioned interior and proximate to floor contacting surfaces 72, 73, 74 of feet 18, 20, 22. As in the case with respect to cross walls 42, 44, 46, outer cross walls 78*a*–78*c* extend generally perpendicular to and are continuous with their respective adjacent side walls and top walls. The bottom edges (only 79*a* shown) of outer cross walls 78*a*–78*c* are upwardly and arcuately curved. Central cylindrical member 48 extends through and above the central upper surface 80 of base 12. Cylindrical member 48 opens upwardly as will be further described below.

Figure 3:
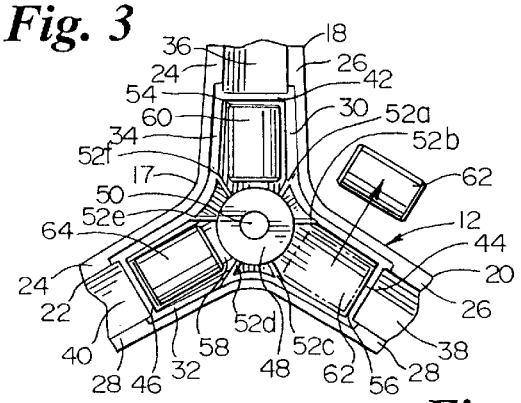
FIG. 3 is a fragmentary, bottom plan view of the base of the stand.
Figure 4:
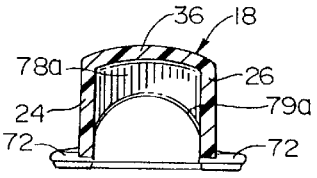
FIG. 4 is a sectional view taken along the line 4—4 of FIG. 2.
Figure 5:
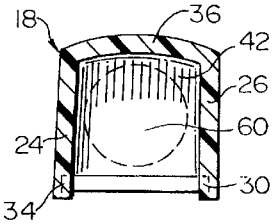
FIG. 5 is a sectional view taken along the line 5—5 of FIG. 2.
Figure 15:
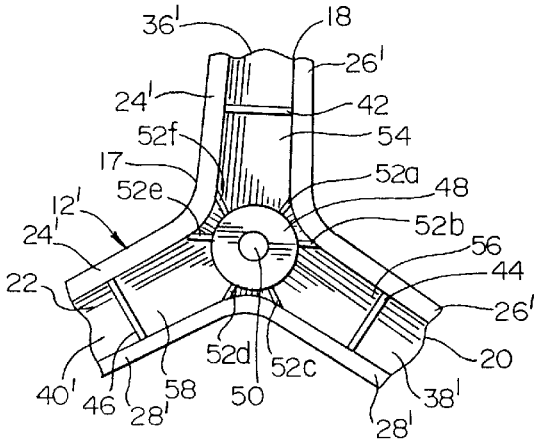
FIG. 15 is a fragmentary, bottom plan view of another embodiment of the bas the stand.

Referring to FIG. 15, base 12' is an alternate embodiment of base 12., for example as shown in FIG. 3. Recessed portions 30, 32, 34 of base 12 are absent in sidewalls 24', 26', 28' of this embodiment, since weights 60, 62, 64 and plate 66 are not present. However, the advantages of one of the inventions herein are still achieved by designing sidewalls 24', 26', 28' and top walls 36', 38', 40' with an increased thickness from the above previously described embodiment. This facilitates manufacture and assembly while maintaining the increased weight and balance proximate a central vertical axis of the entire stand. This further enhances the user interface and helps to minimize tipping during movement or adjustment.

Upright support assembly 14 includes outer tubular member 82, inner tubular member 84, tubular guide 86, anchoring member 88, mounting device 90 and self locking slider mechanism (113). The bottom end 92 of outer tubular member 82 is disposed within cylindrical member 48. Anchoring member 88, in turn, resides within outer tubular member proximate bottom end 92. Anchoring member 88 includes two slotted discs 94, 96, spaced apart and coaxially joined to a central tube 98. Central tube 98 contains interior threads accommodating the threads 71 of bolt 69.

Tubular guide 86 is disposed within tubular member 82 proximate top end 100. Tubular guide 86 includes a smaller diameter portion 102 fitting snugly within outer tubular member 82 and a larger diameter portion 104. The exterior surface of smaller diameter portion 102 preferably includes a circumferential groove 106 juxtaposed to crimp 107 of outer tubular member 82. Larger diameter portion 104 is of a larger exterior diameter than the interior diameter of outer tubular member and is generally located adjacent top end 100. Top 108 of larger diameter portion 104 may be tapered. Rod head 109 of slider mechanism 113 engages crimp 110 to limit the upward movement of slider mechanism 113.

Inner tubular member 84 is slidably, rotatably and telescopically disposed within outer tubular member 82. Inner tubular member 84, in turn, extends through the interior cylindrical cavity of tubular guide 86. Disposed within and proximate the bottom end of inner tubular member 84 is self locking slider mechanism 113. A suitable self locking slider mechanism 113 includes, but is not limited to, that shown in U.S. Pat. No. 4,650,145, assigned to the assignee of the present invention, the entire disclosure of which is hereby incorporated by reference.

Figure 12:
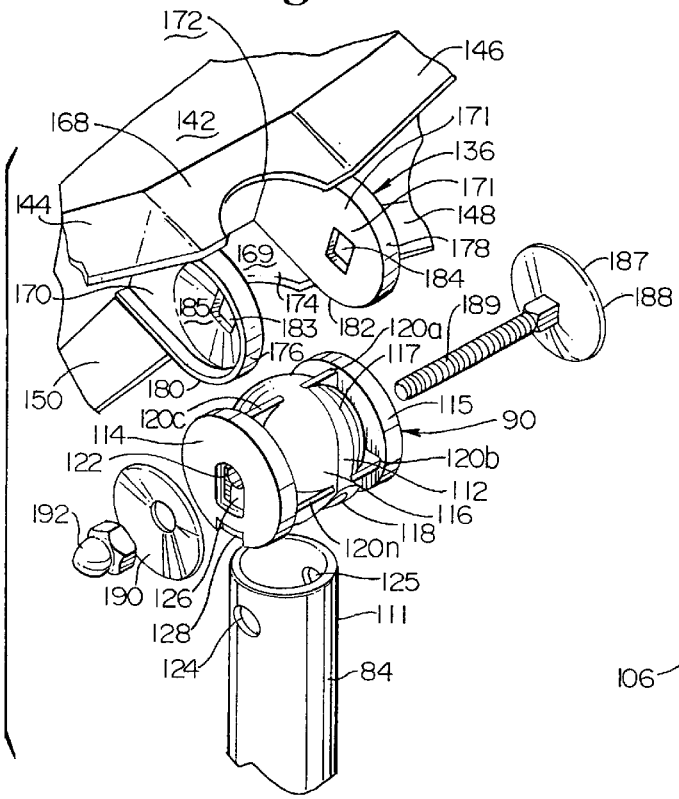
FIG. 12 is a fragmentary, exploded view of the rack mounting device land mounting bracket.
Figure 13:
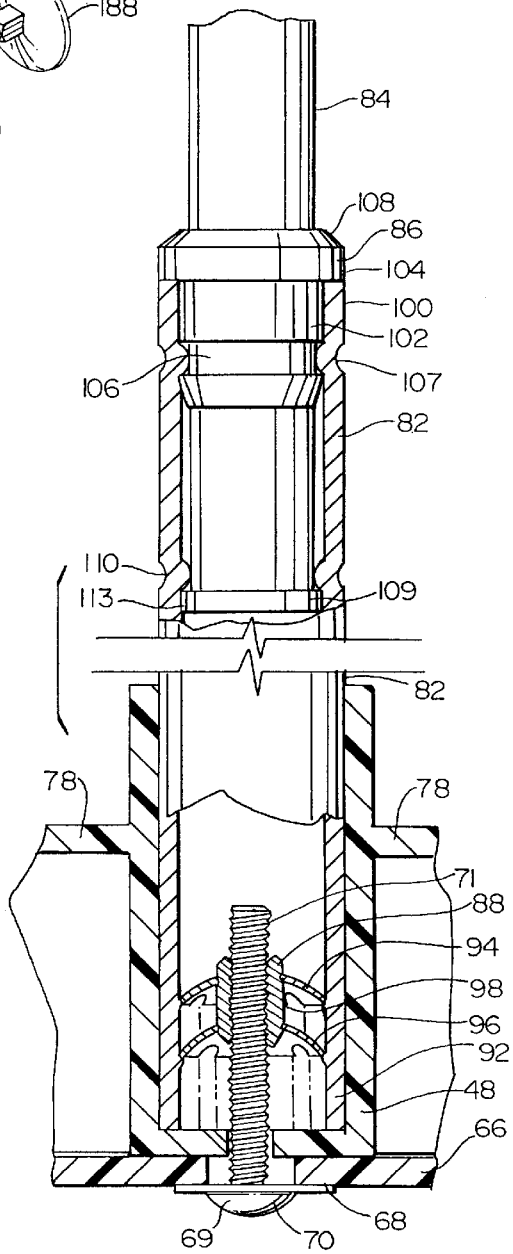
FIG. 13 is a fragmentary, side view of the upright support assembly thereof, with parts cutaway.
Figure 14:
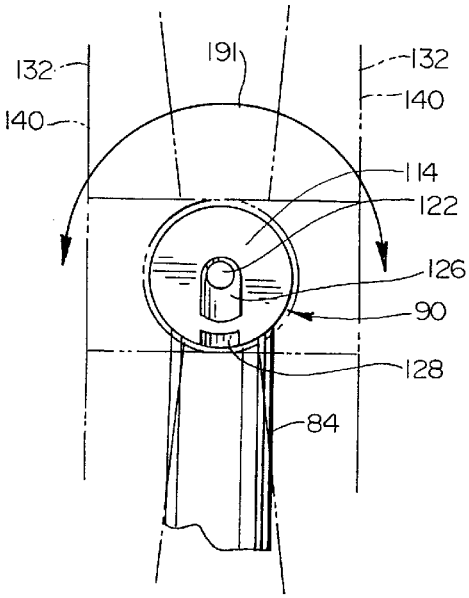

Mounting device 90 is disposed at the upper end 111 of inner tubular member 84. Referring to FIG. 12, mounting device 90 includes a central element 112 and two integral discs 114, 115. Central element 112, with a base 116 and a tapered top 117, defines downwardly opening cavity 118. Discs 114, 115 are opposed to each other along a generally horizontal axis. A plurality of ribs 120*a*–120*n* extend generally horizontally between central element 112 and discs 114, 115. Bore 122 extends generally horizontally through mounting device 90 and aligns with circular openings 124, 125 within inner tubular member 84. Discs 114, 115 each further define a vertically oriented slot (only 126 shown) coincident with the bore 122. The lowermost portions of discs 114, 115 also define an arcuate and circumferential void (only 128 shown) directly below slot 126.

Rack 16 is a unitary member that includes backplate 132, tray 134, Mounting bracket 136 and recess 138. The front surface 140 of backplate 132 i:s, sabstantially planar and ideally has a fine grained texture. A plurality of ribs, integrally molded with backplate 132, are disposed upon the backplate back surface 212.

Mounting bracket 136 is positioned on a central portion of back surface 142. Diagonal ribs 144, 146, 148, 150 extend along back surface 142 from each corner of back plate 132 toward a corresponding corner of mounting bracket 136. Rib 152 extends between diagonal ribs 144, 146. The rib 152 is generally arcuate, and parallel the upper edge 154 of backplate 132. A peripheral rib 160 is disposed about, and integral to, upper edge 154 and side edges 156, 158 of backplate 132. Peripheral rib 160 is generally uniform in depth along the top edge 154 and gradually increases in depth toward the middle of side edges 156, 158.

Short vertical ribs 162, 164 extend between rib 152 and peripheral rib 160. A plurality of reinforcing/gripping ribs 166*a*–166*n* are positioned between vertical ribs 162, 164. Reinforcing/gripping ribs 166*a*–166*n* have generally arcuate exposed edges. The ribs 166*a*–166*n* extend between the inner surface 167 of peripheral rib 160 and backsurface 142.

Referring to FIG. 12, mounting bracket 136 includes two substantially, planar members 168, 169 and two coupling members 170, 171. Outer surfaces 172., 174 of planar members 168, 169 define circular cutouts. Coupling members 170, 171 extend between diagonal rib pairs 144, 150 and between 146, 148, respectively. Coupling members 170, 171 include reinforcing lips 176–178 extending outwardly from rounded upper portions 180–182, and present square openings 183, 184. The circular, outer faces (only 185 shown) of coupling members 170, 171 are inwardly bevelled. Square openings 183, 184 align linearly with bore 122. Coupling members, 170, 171 are spaced apart to accommodate mounting device 90 therebetween. Bolt 187 is received through square openings 183, 184, bore 122 and washer 190, and is secured by nut 192.

Figure 6:
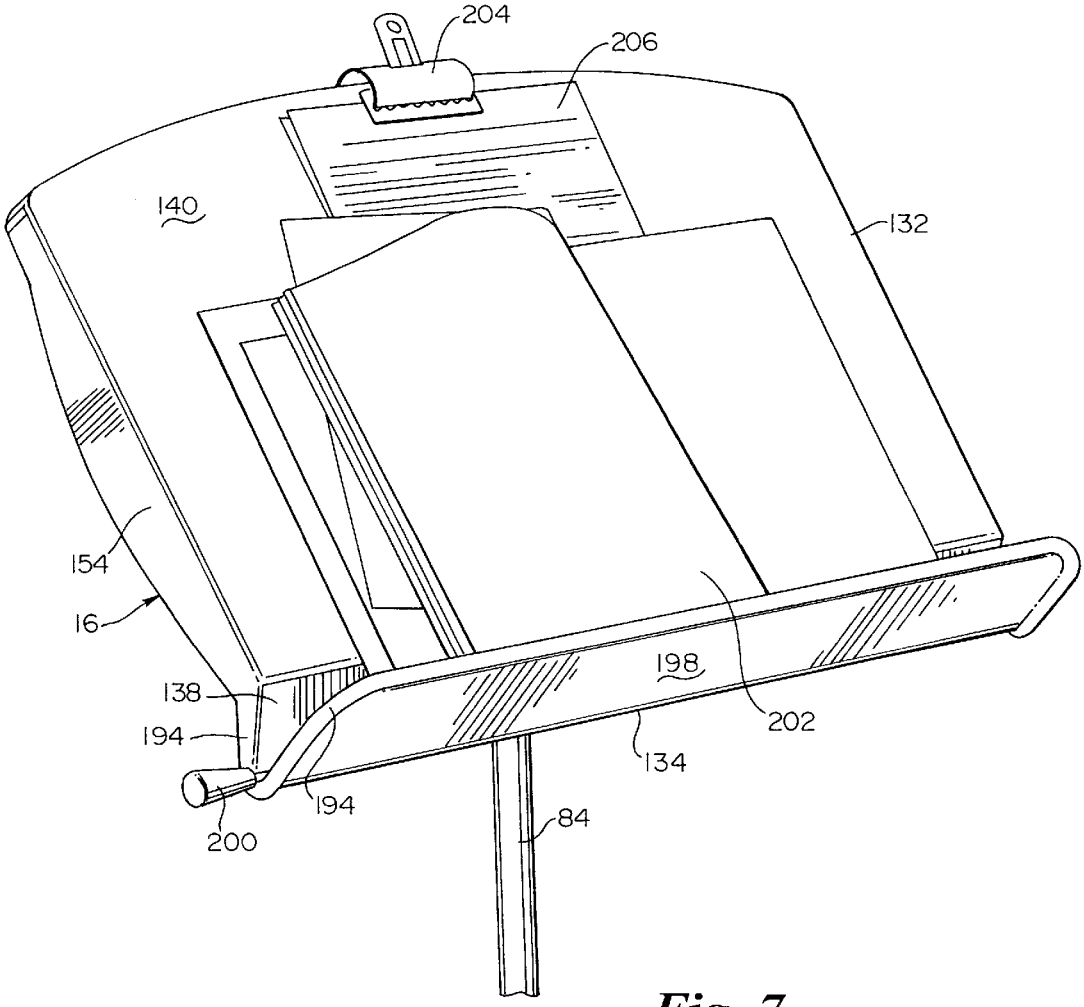
FIG. 6 is a fragmentary, side perspective view of the stand rack.
Figure 7:
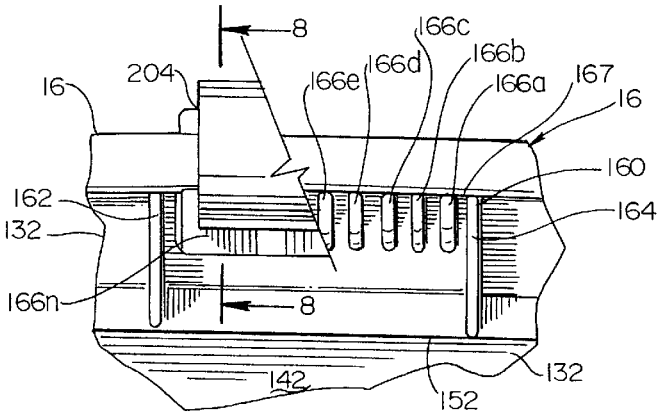
FIG. 7 a fragmentary, rear view of the center top portion of the rack.
Figure 8:
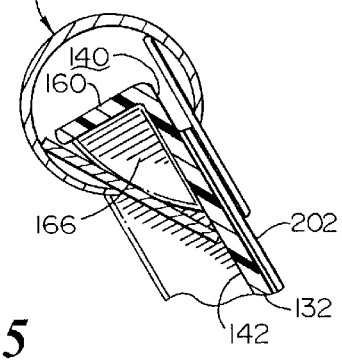
FIG. 8 a fragmentary, sectional view, taken along the line 8—8 of FIG. 7.
Figure 9:
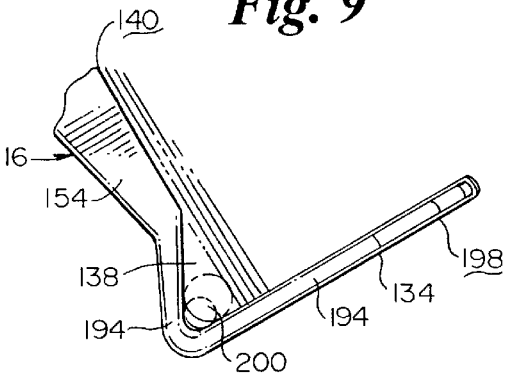
FIG. 9 is a fragmentary, side elevational view of the upper portion of the rack.
Figure 10:
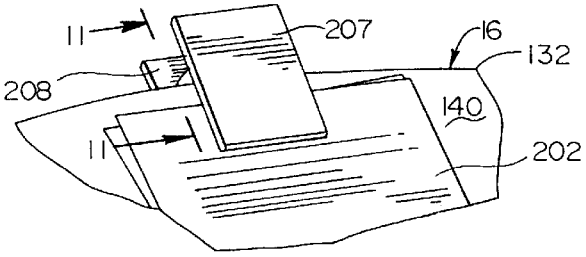
FIG. 10 is a fragmentary, center view of the upper portion of the rack.
Figure 11:
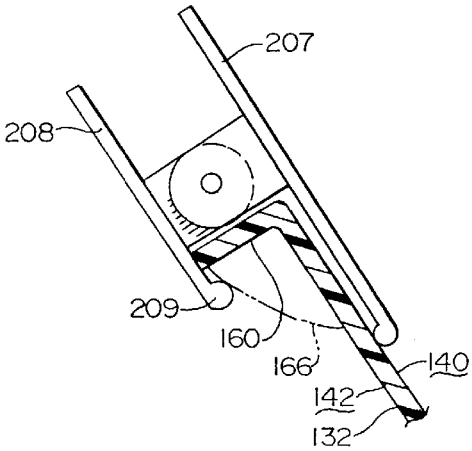
FIG. 11 is a sectional view taken along the line 11—11 of FIG. 10.

Referring to FIGS. 6 and 9, recess 138 is an angular extension of backplate 132, extending generally away from front surface 140. Planar tray 134 is continuous with recess 138, and is oriented generally perpendicular to backplate 132. Peripheral lip 194 is continuous with peripheral rib 160, and extends along the edges of tray 134 and recess 138. Like that of front surface 140, upper surface 196 of tray 134 preferably has a fine grained texture. The lower surface 198 of tray 134 can be smooth or textured.

Base 12 and rack 16, with the exception of weights 60, 62, 64 and plate 66, are preferably and predominately made of molded or injected synthetic resin The synthetic resin is lightweight, extremely durable, and can be presented with an appealing fine grain texture. Cross walls 42, 44, 46, outer cross walls 78*a*–78*c* and diagonal walls 52*a*–52*f* are integral with adjacent surfaces and provide for added support and rigidity. Plate 66, while ideally made of a synthetic resin, may also be formed from other materials including steel and aluminum. Although preferably made of metals such as steel, cylindrical weights 60, 62, 64 can be made of any materials and in other shapes conformable to cavities 54, 56, 58 and which would impart sufficient weight to base 12, hence stability to stand 10. Alternative cavity shapes and dimensions are possible by altering the relative positions of cross walls 42, 44, 46 and/or diagonal walls 52*a*–52*f*.

Outer tubular member 82, inner tubular member 84 and anchoring member 88 are preferably made of a stiff metal such as steel or aluminum, but may be constructed using stiff and resilient synthetic resin. Tubular guide 86 and mounting device 90 are optimally constructed using relatively stiff materials such as synthetic resin and are optimally made by mold injection. Ribs 120*a*–120*n* function to provide further strength and rigidity to mounting device 90.

Assembly of the stand 10 will now be described, it being understood that the sequence of assembly is not necessarily in the order of description. Anchoring member 88 is forced into outer tubular member 82 from bottom end 92, thereby biasing slotted discs 94–96 downwardly. Bottom end 92 of tubular member 82 is of an appropriate inner diameter to fit snugly into the interior of cylindrical member 48. Weights 60, 62, 64 are then placed into cavities 54, 56, 58. Plate 66 is placed over the bottom of base 12, securing weights 60, 62, 64 therewithin, thereby providing greater stability to stand 10. Bolt 69 is placed through washer 68, plate 66 and opening 50, and rotated into the threads within central tube 98 of anchoring member 88, or as described, above. Plate 66 and weights 60, 62, 64 may also be secured in place by sonic welding.

Tightening bolt 69 applies tension to anchoring member 88 against the bias of slotted discs 94, 96, thereby anchoring outer tubular member 82 firmly to base 12. Self locking slider mechanism 113 is installed within the bottom end of inner tubular member 84 as described in U.S. Pat. No. 4,650,145. Inner tubular member 84, with installed self locking slider mechanism 113, is then inserted into the bottom end of outer tubular member 82. The protruding end of inner tubular member 84 is inserted through tubular guide 86. The outer dimension of the smaller portion 102 and the inner dimension of outer tubular member 82 are such that a snug fit is attained when the smaller portion 102 of tubular guide 86 is inserted into the upper end 100 of outer tubular member 82 until the larger diameter portion 104 contacts outer tubular member 82, thereby aligning circumferential groove 106 with crimp 107.

The upper end 111 of inner tubular member 84 is placed into cavity 113 of mounting device 90 and rotated therewithin until bore 122 aligns with openings 124, 125. Coupling members 170, 171 are placed exterior to central element 112 and square openings 183, 184 aligned with aligned bore 122 and openings 124, 125. Bolt 187 is passed through these openings, bore 122 and further through washer 190 until head 188 contacts disc 115 and the threads 189 emerge. Vertical slot 126 accommodates the square base of bolt 187 thereby preventing bolt 187 from turning ashen nut 192 is being tightened. Nut 192 is rotated onto the threads of bolt 187 until a desired level of tension is imparted to the assembled, horizontally rotatable apparatus. The semicircular cutouts in planar members 168, 169 enable a 180° rotation of rack 16 about a generally horizontal axis (arc 191) defined by a radius coaxial to bore 122.

Diagonal ribs 144, 146, 148, 150, horizontal rib 152 and vertical ribs 162, 164 impart greater rigidity and strength to backplate 132. Peripheral rib 160 and lip 194 likewise impart greater strength and rigidity to the edges of rack 16.

In use, the lightweight stand is easily carried to a desired location. The height of rack 16 is adjusted by grasping rack 16 or inner tubular member 84 with one hand and outer tubular member 82 with the other hand. Inner tubular member 84 is then raised or lowered as desired, thereby adjusting the height. Alternately, inner tubular member 84 or rack 16 is grasped as described above. The user then rests the user's foot or a weight upon base 12 and raises or lowers inner tubular member 84 until rack 16 attains the desired height. The vertical angle of rack 16 is then adjusted by grasping rack preferably with both hands and rotating rack 16 on a horizontal axis until the correct vertical angle is attained. Tightening or loosening nut 192 will increase or decrease the force necessary to adjust the vertical angle of rack 16. The orientation of feet 18, 20, 22 or rack 16 can be further altered by rotating inner tubular member within outer tubular member. The user can then place such items as pencils, markers and a baton within the cavity defined by recess 138 and tray 134 for later access. Finally, the user may place music or other printed matter upon. rack 16, securing it with a clip such as clip 204, 207 if desired.

During storage and transport, the design of the present invention allows for minimum space requirements. Rack 16 may be rotated through an entire 180° arc, thereby enabling tray 134 to be positioned at either the extreme top or bottom of arc 191. With this feature, adjacent stands can then be stored with rack 16 in alternate extreme top or bottom positions. The orientation of feet 18, 20, 22 may be adjusted as described above to effect a still more efficient space utilization. Finally, rack 16 may be easily removed and stowed apart from the remainder of stand 10 for even more efficient space utilization during transport or storage by removing bolt 187.

The cavity defined by recess 138 and tray 134 is an advantageous feature of the present invention. When in use, a baton 200, for example, may be placed within the cavity defined by recess 138 and by tray 134 under bound and/or loose papers 202, which are resting on front surface 140. The user may sort through these papers without removing or inadvertently displacing baton 200 entirely from rack 16 to the floor. Furthermore baton 200 is easily located and conveniently available when needed. Any number and type of articles may be placed within recess 138, thereby enabling the user to easily locate the desired articles in this manner, yet freely leaf through papers 200.

Another desirable feature of the present invention is illustrated by the presence of clip 204 on backplate 132. The ability to securely attach a clip such as clip 204 is enabled by the presence of reinforcing/gripping ribs 166*a*–166*n*, which provide a surface upon which the back portion of clip 204 can be securely positioned. Clip 204 may be used to further secure sheets 206, or some other item, to rack 16 so that wind or inadvertent bumping will not dislodge sheets 206 from stand 10. Different clamps, such as clamp 207, suitable for mounting a lamp to the stand, which include rear lever 208, with gripping lip 209 thereupon, benefit from the presence of reinforcing/gripping ribs 166*a*–166*n* to properly grip the back of rack 16.

Because numerous modifications may be made of this invention without departing from the spirit and scope thereof, the scope of the invention is not to be limited to the embodiments illustrated and described. Rather, the scope of the present invention is to be determined by the appended claims and their elements.

What is claimed is:

1. A stand, comprising:

a weighted base, having a plurality of legs each of the plurality of legs having at least one recess defined therein, a weight being disposed in the at least one recess of each of the plurality of legs;

a rigid upright support assembly including a first tubular member and a second tubular member, said first tubular member operably joined to said base, said second tubular member and said first tubular member being telescopically, frictionally coupled in a variable, vertically adjustable fit; and a rack operably, pivotally coupled to said second tubular member, including a generally planar back section having opposed front and rear faces, said rear face including a plurality of integral, reinforcing support ribs disposed on said second surface, said rack further including a lower lip section oriented transversely to said back section, the lower lip section having a recessed juncture between said back section and said lip section, the recessed juncture defining a recess, the recess depending from the plane of the back section.

2. The stand of claim 1 wherein the weight is retained in the at least one recess of each of the plurality of legs by a weldment.

3. The stand of claim 2 wherein a document disposed on the front face of the rack may overlie at least a portion of the recess, an edge margin of the document being supported by the lower lip section.

4. The stand of claim 1 wherein the rack back section and the rack lower lip section are formed integrally as a unit.

5. The stand of claim 1 wherein the rack back section presents an edge margin disposed opposite to the lower lip section, the edge margin having a compressive document-retaining clip operably coupled thereto.

6. A stand, comprising:

a base for resting on a supporting surface, the base being weighted for providing a stabilizing mass proximate the supporting surface, the weighted base includes a plurality of legs, each of the plurality of legs having at least one recess defined therein, at least one weight being disposed in the at least one recess of each of the plurality of legs;

a rigid upright support assembly including a first tubular member and a second tubular member, said first tubular member operably joined to said base, said second tubular member and said first tubular member being telescopically, frictionally coupled in a variable, vertically adjustable fit; and a rack operably, pivotally coupled to said second tubular member, including a generally planar back section, a lower lip section being operably coupled to said back section by a recessed juncture between said back section and said lip section, the recessed juncture defining a recess, the recess depending from the plane of the back section.

7. The stand of claim 6 wherein the at least one weight is retained in the at least one recess of each of the plurality of legs by a weldment.

8. The stand of claim 7 wherein a document disposed on the front face of the rack may overlie at least a portion of the recess, an edge margin of the document being supported by the lower lip section.

9. The stand of claim 6 wherein the rack back section and the rack lower lip section are formed integrally as a unit.

10. The stand of claim 6 wherein the rack back section presents an edge margin disposed opposite to the lower lip section, the edge margin having a compressive document-retaining clip operably coupled thereto.

11. A stand, comprising:

a base for resting on a supporting surface, the base being weighted for providing a stabilizing mass proximate the supporting surface, the weighted base having a plurality of legs, each of the plurality of legs having at least one recess defined therein, at least one weight being disposed in the at least one recess of each of the plurality of legs;

a rigid upright support assembly being operably joined to said base; and a rack operably coupled to said upright support, including a generally planar back section, a lower lip section being operably coupled to said back section by a recessed juncture between said back section and said lip section, the recessed juncture defining a recess, the recess depending from the plane of the back section.

12. The stand of claim 11 wherein the at least one weight is retained in the at least one recess of each of the plurality of legs by a weldment.

13. The stand of claim 12 wherein a document disposed on the front face of the rack may overlie at least a portion of the recess, an edge margin of the document being supported by the lower lip section.

14. The stand of claim 11 wherein the rack back section and the rack lower lip section are formed integrally as a unit.

15. The stand of claim 11 wherein the rack back section presents an edge margin disposed opposite to the lower lip section, the edge margin having a compressive document-retaining clip operably coupled thereto.

16. The stand of claim 11 wherein the rigid upright support assembly includes a first tubular member and a second tubular member, said first tubular member operably joined to said base, said second tubular member and said first tubular member being telescopically, frictionally coupled in a variable, vertically adjustable fit.

17. The stand of claim 11 wherein the rack planar back section has opposed front and rear faces, said rear face including a plurality of integral, reinforcing support ribs disposed on said second surface and wherein said rack lower lip section is oriented transversely to said back section.

* * * * *

UNITED STATES PATENT AND TRADEMARK OFFICE

CERTIFICATE OF CORRECTION

PATENT NO. : 5,833,199
DATED : November 10, 1998
INVENTOR(S) : Benting et al.

It is certified that error appears in the above-identified patent and that said Letters Patent is hereby corrected as shown below:

In the Abstract, line 1, after "music" insert —stand—.

Column 1, line 16, after "implements" delete ",".

Column 1, line 26, after "a" delete ".".

Column 1, line 28, delete "proven" and insert —prone—.

Column 1, line 44, delete "145" and insert —'145--.

Column 2, line 19, after stand delete ":" and insert —;—.

Column 2, line 27, after "7" insert —is—.

Column 2, line 29, after "8" insert —is—.

Column 2, line 39, delete "land" and insert —and—.

Column 2, line 46, delete "bas" and insert —base—.

Column 2, line 54, after "feet" delete ":".

UNITED STATES PATENT AND TRADEMARK OFFICE

CERTIFICATE OF CORRECTION

PATENT NO. : 5,833,199

DATED : November 10, 1998

INVENTOR(S) : Benting et al.

It is certified that error appears in the above-identified patent and that said Letters Patent is hereby corrected as shown below:

Column 5, line 20, after "resin" insert —.—.

Column 5, line 46, delete "94–96" and insert —94, 96—.

Column 5, line 54, after "described" delete ",".

Column 6, line 7, delete "113" and insert —118—.

Column 6, line 15, delete "ashen" and insert —when—.

Column 6, line 36, after "rack" insert —16—.

Column 6, line 45, after "upon" delete ".".

Column 7, line 2, delete "placed" and insert —emplaced—.

Column 7, line 20, delete "of" and insert —to—.

Column 2, line 55, delete "1" and insert —12—.

Column 2, line 58, delete "each" and insert —Each—.

Column 2, line 63, delete "legs" and insert —feet—.

Column 3, line 9, delete "52a-52f" and insert —52*a*-52*f*—.

Column 3, line 44, after "12" delete "." and insert —,—; after "example" insert —,—.

UNITED STATES PATENT AND TRADEMARK OFFICE

CERTIFICATE OF CORRECTION

PATENT NO. : 5,833,199 Page 3 of 3

DATED : November 10, 1998

INVENTOR(S) : Benting et al.

It is certified that error appears in the above-identified patent and that said Letters Patent is hereby corrected as shown below:

Column 4, line 37, delete "Mounting" and insert —mounting—.

Column 4, line 38, delete "i:s, sabstantially" and insert —is substantially—.

Column 4, line 41, delete "212" and insert —142—.

Column 4, line 62, after "172" delete "." and insert —,—.

Column 5, line 4, after "members" delete ",".

Signed and Sealed this

Twenty-second Day of June, 1999

*Attest:*

Q. TODD DICKINSON

*Attesting Officer*

*Acting Commissioner of Patents and Trademarks*